United States Patent [19]

Solo

[11] 4,381,635

[45] May 3, 1983

[54] INSTANT TRUSS ROOF SUPPORT SYSTEM

[76] Inventor: Charles P. Solo, 27 W. 336 Mardon Rd., West Chicago, Ill. 60185

[21] Appl. No.: 191,851

[22] Filed: Sep. 29, 1980

[51] Int. Cl.[3] ..... E04C 5/18; E04C 3/17

[52] U.S. Cl. ..... 52/639

[58] Field of Search ..... 52/639–642, 52/690, 692, 92, 93; 403/230, 231, 232.1, 190, 4, 58

[56] References Cited

U.S. PATENT DOCUMENTS

| | | | |
|---|---|---|---|
| 408,750 | 8/1889 | Rockwell et al. | 52/690 |
| 933,067 | 9/1909 | Ferry | 403/231 |
| 2,083,055 | 6/1937 | Coddington | 52/690 |

FOREIGN PATENT DOCUMENTS

| | | | |
|---|---|---|---|
| 555935 | 4/1923 | France | 52/93 |
| 719895 | 11/1931 | France | 403/190 |
| 863582 | 1/1941 | France | 52/92 |
| 539356 | 9/1941 | United Kingdom | 52/639 |

*Primary Examiner*—James L. Ridgill, Jr.

*Attorney, Agent, or Firm*—Norman Lettvin

[57] ABSTRACT

An add-on roof reinforcing brace is disclosed for buttressing the structural strength of roof rafters which have been weakened by age and deterioration. The add-on brace of the present invention provides a quick and economical means of vertically orientating a square-cut stud, between an angled roof rafter and a horizontally disposed ceiling joist. To this end, a joist attachment member secures one distal end of the stud to the ceiling joist and a rafter attachment member secures the other distal end of the stud to the roof rafter. The rafter attachment member includes a sleeve for attaching said rafter attachment member to the other end of the stud, a saddle-shaped member for attaching said rafter attachment member to a roof rafter, and a pivot member for pivotably interconnecting the sleeve and the saddle-shaped member. The sleeve member may be selectively angulated relative to the saddle-shaped member to dispose the stud in a generally vertical attitude regardless of the geometric angle between the roof rafter and the ceiling joist.

11 Claims, 6 Drawing Figures

FIG. 1
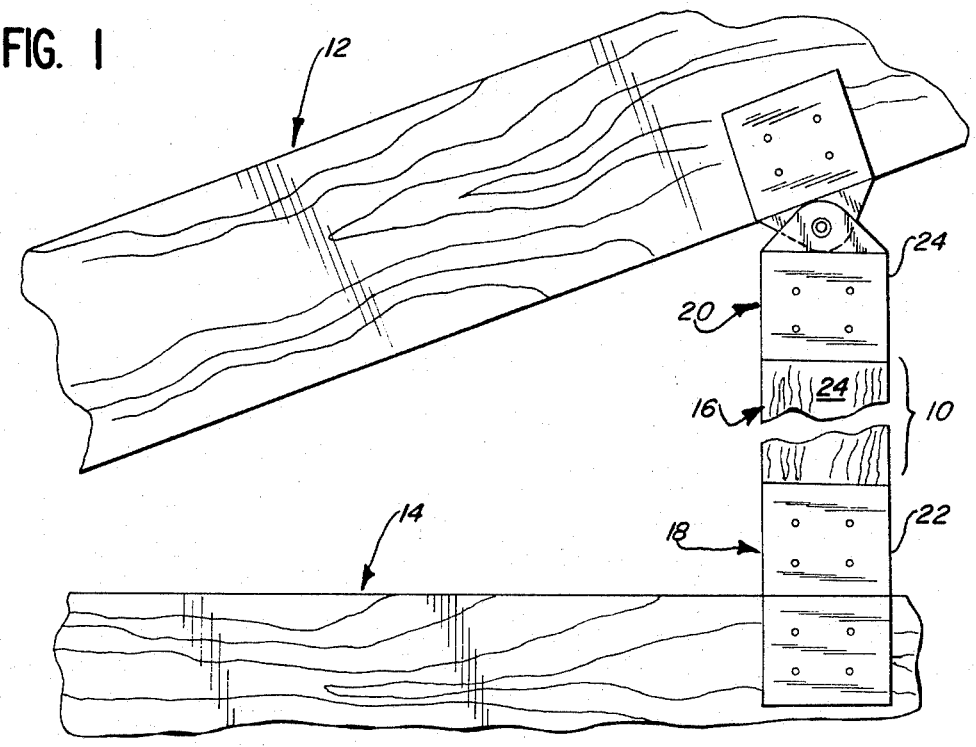
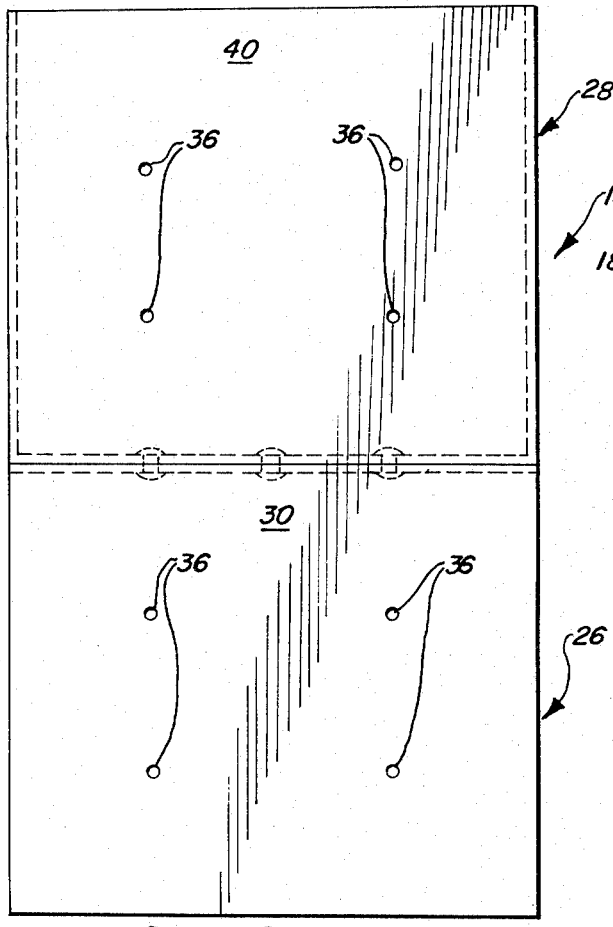
FIG. 2
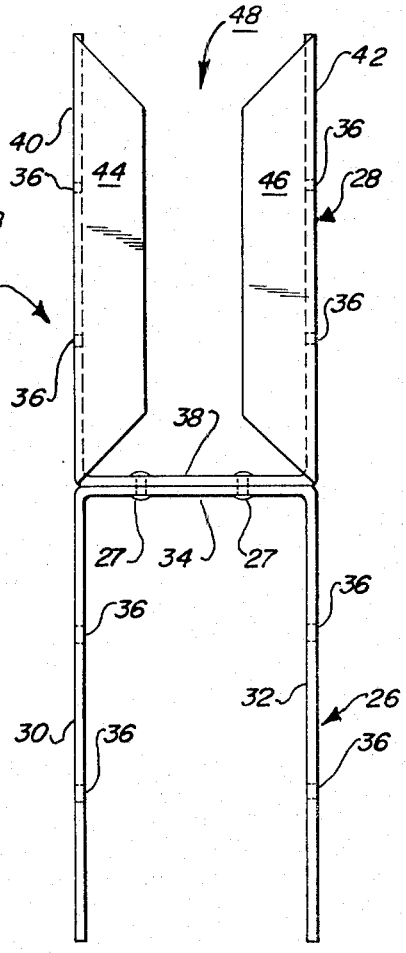
FIG. 3

FIG. 4
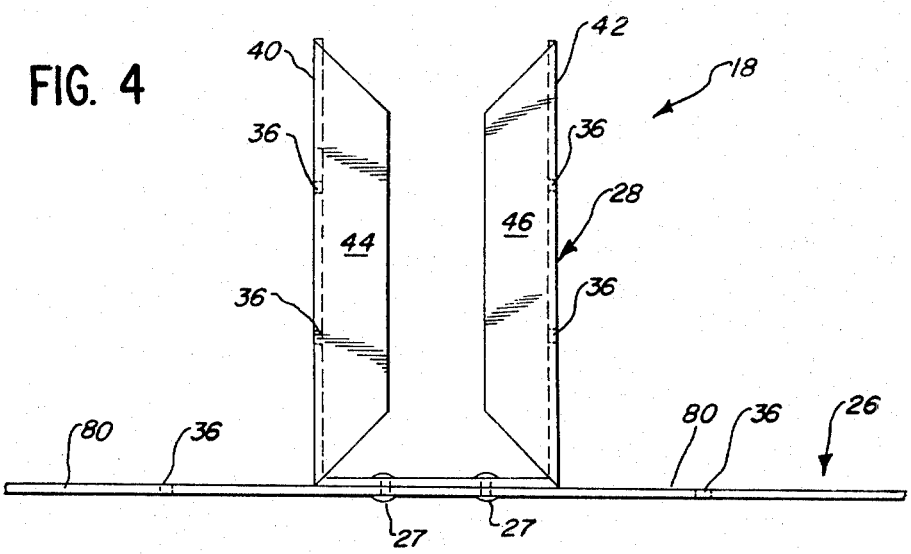
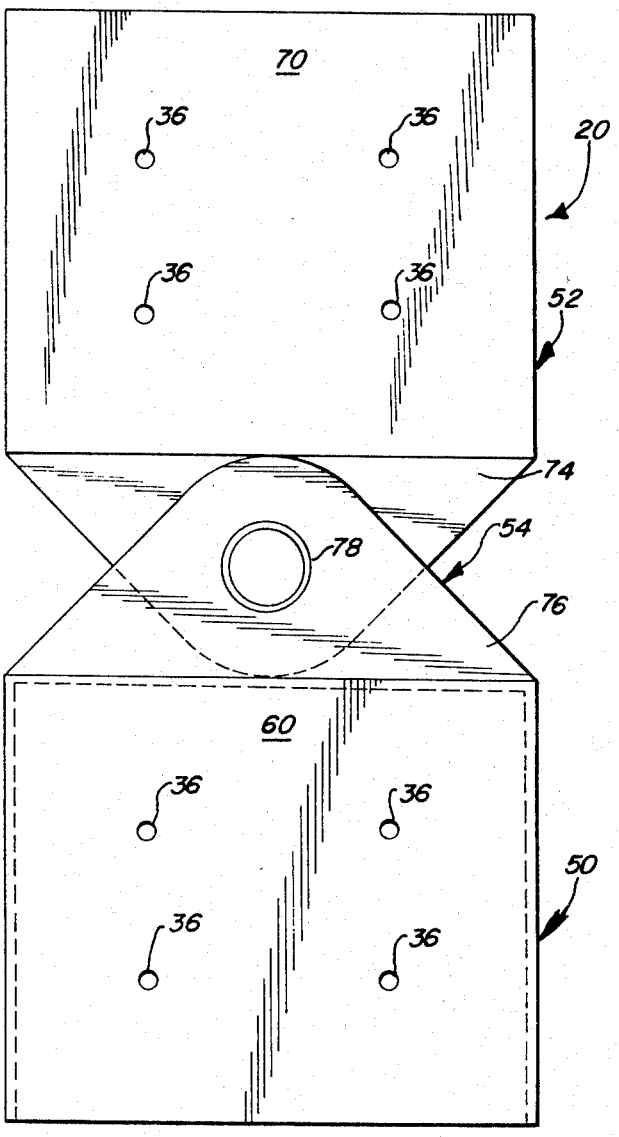
FIG. 5
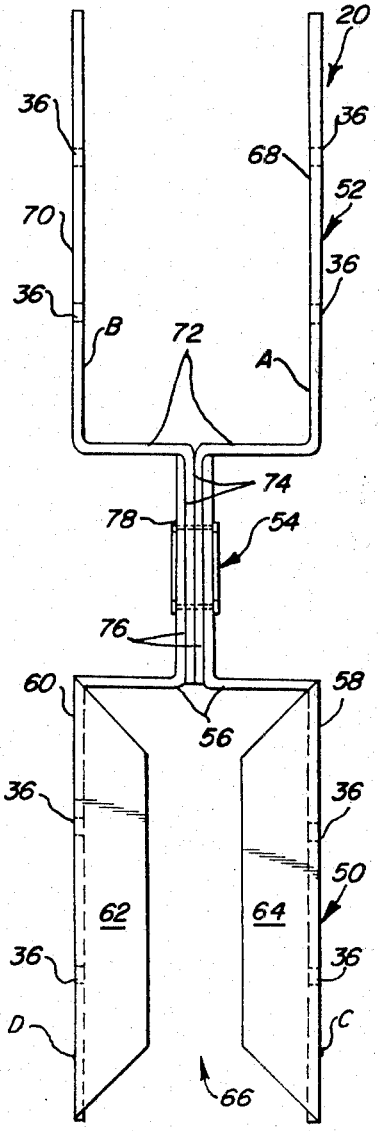
FIG. 6

INSTANT TRUSS ROOF SUPPORT SYSTEM

FIELD OF THE INVENTION

This invention relates generally to braces for the reinforcement of roof structures and, more particularly, to a roof reinforcing brace which can be quickly attached to and span the vertical space between an angled roof rafter and a horizontally disposed ceiling joist.

BACKGROUND OF THE INVENTION

In buildings constructed with sloping roofs, a plurality of spaced, parallel beams known as "rafters" form the supporting structure to which the roof surface, i.e., plywood sheets, are nailed. The plywood sheets and the roof rafters must not only support asphalt shingles or other weatherproofing material, but must also support normal loads to which the roof surface is routinely subjected.

As buildings age, the rafters deteriorate and the once sturdy roof surfaces are unable to withstand such normally encountered surface loads as heavy snow accumulations or the weight of people standing thereon to check for leaks, or to shovel said snow accumulations, or to clean gutters.

Weakened roof structures have previously been strengthened by securing the ends of add-on elongated wooden studs between horizontally disposed ceiling joists and the angled roof rafters positioned thereabove. To properly adapt the stud, the upper end of the stud would be sawed off so that the angle thereof would approximate the angle formed by the rafters relative to the joists, and the length of stud would be selected to effect the desired connection between joists and rafters, nailing the stud to the respective rafters and joists. However, inherent problems exist with this type of buttressing technique for homeowners who are not skilled carpenters. Thus, it is a problem to accurately reproduce the rafter-joist angle at the upper end of the stud without expending a good deal of time. If the angle is not accurately reproduced when the stud is forced between the rafter and the joist, the upper and lower end surfaces of the stud will not be in full surface area contact with, respectively, the bottom rafter surface and the upper joist surface, and the surface area for effecting load support is not maximized. Another problem involves the time expended in measuring and cutting the stud so as to closely approximate the rafter-joist angle. With the high cost of carpenters currently in effect, a reduction in the time required to securely position a bracing member, multiplied by the many bracing members necessary to buttress an entire roof, will greatly reduce overall labor costs.

It is therefore one object of the present invention to provide an add-on reinforcing brace for use between rafters and joists, which brace can be quickly and easily positioned between the angled roof rafters and horizontally disposed ceiling joists without the labor necessary to duplicate the rafter-joist angle at the upper surface of said brace.

It is yet another object of the present invention to provide an add-on reinforcing brace for roof structures which reduces labor expenses incurred in mounting said brace between a ceiling joist and a roof rafter.

These and other objects and advantages of the invention will become clear from the description of the drawings and invention which follow.

SUMMARY OF THE INVENTION

There is disclosed herein an add-on roof reinforcing brace for use between a roof rafter and a ceiling joist. The roof rafter is normally spaced vertically above and angled with respect to the generally horizontally disposed ceiling joist. The roof reinforcing brace of the present invention includes elongated stud means, joist attachment means and rafter attachment means.

The elongated stud means is a square-cut member adapted to substantially span the vertical distance between a roof rafter and a ceiling joist and includes opposed distal ends.

The joist attachment means is adapted to secure one distal end of the stud means to a ceiling joist and includes saddle means and sleeve means. The saddle means comprises a generally U-shaped member defined by a pair of parallel side sheets spaced apart by a bight member. The sleeve means comprises a hollow, generally rectangularly-shaped member formed by a bottom member, a pair of side sheets, flanged portions of each of the side sheets defining edge enclosing sheets, and an open top end opposite the bottom member to receive therein the one distal end of the stud means. The bight member of the saddle means is secured to the bottom member of the sleeve means to form an integral structure.

The rafter attachment means is adapted to secure the other distal end of the stud means to a roof rafter and includes saddle means, sleeve means and means pivotally interconnecting the sleeve means and the pivot means. The saddle means comprises a generally U-shaped member defined by a pair of parallel side sheets spaced apart by a bight member. The sleeve means comprises a hollow, generally rectangularly-shaped member formed by a top member, a pair of side sheets, flanged portions of each of said side sheets of said sleeve means defining edge enclosing sheets, and an open bottom end opposite the top member to receive therein the other distal end of the stud means. The pivot means comprises saddle extension means of the saddle means extending away from the bight member in a direction opposite the direction from which the side sheets extend, sleeve extension means of the sleeve means extending away from the top sheet in a direction opposite the direction from which the side sheets of the sleeve means extend and pivot means connecting the saddle extension means and the sleeve extension means so as to provide for selective angulation therebetween.

BRIEF DESCRIPTION OF THE DRAWINGS

FIG. 1 is a front view showing the reinforcing brace of the present invention secured to and supporting a roof rafter which is positioned above and angled relative to a horizontally disposed ceiling joist;

FIG. 2 is an enlarged front view of the ceiling joist attachment member shown in FIG. 1;

FIG. 3 is an enlarged side elevational view of the ceiling joist attachment member shown in FIG. 1;

FIG. 4 is a side elevational view of a modified embodiment of the ceiling joist attachment member shown in FIG. 3;

FIG. 5 is an enlarged front view of the roof rafter attachment member shown in FIG. 1; and FIG. 6 is an enlarged side elevational view of the roof rafter attachment member shown in FIG. 1.

DETAILED DESCRIPTION OF THE DRAWINGS

Referring now to the drawings and specifically to FIG. 1, the roof reinforcing brace of the present invention is shown generally at 10. In FIG. 1, the brace 10 is operatively positioned in a generally vertical attitude between an angled roof rafter 12 and a generally horizontally disposed ceiling joist 14. The roof reinforcing brace 10 includes an elongated stud 16, a joist attachment member 18 and a rafter attachment member 20.

The elongated stud 16 is preferably a wooden board having oppositely disposed, square-cut, distal ends 22 and 24, a pair of side surfaces (only one side 24 is illustrated in the drawings) and a pair of edge surfaces (not illustrated). Although a wooden board is preferred, it is to be understood that other materials may be employed without departing from the spirit and scope of the invention.

One preferred embodiment of the joist attachment member 18 is shown in FIGS. 2–3. The joist attachment member 18 includes a saddle member 26 and a sleeve member 28. The saddle member 26 is a generally U-shaped member defined by a pair of parallel side sheets 30 and 32 spaced apart by a bight member 34. Each of the side sheets 30 and 32 have a plurality of holes, such as 36, formed therethrough.

The sleeve member 28 of the joist attachment member 18, is a hollow, substantially enclosed, generally rectangularly-shaped member formed by a bottom member 38, a pair of parallel side sheets 40 and 42, each of which have flanged portions defining edge enclosing sheets 44 and 46, and an open top end 48 opposite said bottom member 38. Each of the side sheets 40 and 42 have a plurality of holes, such as 36, formed therethrough. The bight member 34 of the saddle member 26 and the bottom member 38 of the sleeve member 28 are secured together by means such as rivets 27.

The rafter attachment member 20 is shown in FIGS. 5–6 and includes a sleeve member 50, a saddle member 52, and means 54 pivotably interconnecting the sleeve member 50 and the saddle member 52. The sleeve member 50 is a hollow, substantially enclosed, generally rectangularly-shaped member forming a top member 56, a pair of parallel side sheets 58 and 60, each of which have flanged portions defining edge enclosing sheets 62 and 64, and an open bottom end 66 opposite said top member 56. Each of the side sheets 58 and 60 have a plurality of holes, such as 36, formed therethrough.

The saddle member 52 of the rafter attachment member 20 is a generally U-shaped member defined by a pair of parallel side sheets 68 and 70 shaped to form and spaced apart by a bight member 72. Each of the side sheets 68 and 70 have a plurality of holes, such as 36, formed therethrough.

The means 54 for pivotably interconnecting the sleeve member 50 and the saddle member 52 comprises saddle extension sheet means 74 extending away from said bight member 72 of the saddle member 52 in a direction opposite the direction from which the side sheets 68 and 70 extend, sleeve extension sheet means 76 extending away from said top member 56 of the sleeve member 50 in a direction opposite the direction from which the side sheets 58 and 60 extend, and pivot means 78 connecting the saddle extension means 74 and the sleeve extension means 76, which, as clearly shown in FIG. 6, lie adjacent each other. The pivot means 78 is a rivet, the diameter and thickness of which may vary in proportion to the load which the brace 10 must support.

The sleeve member 28 and the saddle member 26 of the joist attachment member 18 and the sleeve member 50, the saddle member 52 and the means 54 pivotably interconnecting the sleeve member 50 and the saddle member 52 of the rafter attachment member 20 are all preferably formed from sixteen (16) gauge galvanized steel. By using a 16-gauge thickness, the sleeve member 28 and the saddle member 26 of the joist attachment member 18 may each be formed from a single sheet of steel, configured to conform to the shape of the stud 16 and the ceiling joist 14, respectively. It should be readily apparent that the saddle member 26 may be pre-folded to the shape illustrated in FIGS. 2 and 3 or used in an unfolded state as illustrated in FIG. 4. The embodiment of FIG. 4 can be used to attach the stud means 16 to a ceiling joist 14 by nailing the unfolded steel sheet 80 to the upper surface of said joist. Alternatively, the steel sheet 80 can be folded about the joist 14 to assume the configuration of FIGS. 3 and 4 in which the side sheets 30 and 32 are nailed (through nail holes 36) to the sides of the ceiling joist 14.

Viewing FIG. 6, it is clear that the saddle member 52 and the sleeve member 50 of the rafter attachment member 20 are each formed from two sheets of galvanized steel. In other words, the saddle member 52 of the rafter attachment member 20 is formed by sheets A and B and the sleeve member 50 of the rafter attachment member 20 is formed by sheets C and D. Sheet A is folded to include side sheet 68, part of the bight member 72 and part of the saddle extension means 74. Sheet C is folded to include side sheet 58, edge enclosing sheets 64, part of the top member 56 and part of the sleeve extension means 76. Sheets C and D are mirror images of sheets A and B respectively. The pivot means 78 is crimped about the saddle extension means 74 and the sleeve extension means 76 so as to (1) form sheets A and B into a generally U-shaped member; (2) form sheets C and D into a generally enclosed, rectangularly-shaped member; and (3) pivotably connect the saddle means 52 to the sleeve means 50.

Although 16 gauge galvanized steel has been described as the preferred material from which to fashion both the joist attachment member 18 and the rafter attachment member 20, other low-cost materials having high tensile strengths can be employed without departing from the spirit and scope of the invention. It is also contemplated that both the saddle means 52 and the sleeve means 50 be integrally formed, as opposed to their preferred fabrication from sheets A and B and sheets C and D respectively.

OPERATION

When it is necessary to provide additional support for roof rafters such as 12 that have become weakened with age, a wooden stud 16 is cut to approximate the vertical distance between said rafter 12 and a ceiling joist 14 at the point that the support is deemed necessary. The parallel side sheets 40 and 42 of the sleeve member 28 of the joist attachment member 18 are nailed through holes 36 to the opposite sides of the stud 16 after the one distal end 22 of said stud 16 is slipped through the open end 48 of the said sleeve member 28. The other distal end 24 of the stud 16 is slipped through the open end 48 of the rafter attachment member 20. The parallel side sheets 58 and 60 are then nailed through holes 36 to opposite sides of the stud 16.

The stud 16, with the joist attachment member 18 and the rafter attachment member 20 nailed thereto is then positioned in a substantially vertical attitude between the rafter 12 and the joist 14. This is accomplished by first slipping the saddle member 26 of the joist attachment member 18 over the ceiling joist 14 and then sliding the brace assembly 10 along said joist 14 until the bight member 72 of the saddle member 52 of the rafter attachment member 20 is pivoted to abut, in surface-to-surface relation, the bottom surface of said rafter 12. Now the side sheets 40 and 42 of the saddle member 52 of the rafter attachment member 20 are nailed through holes 36 to the opposite sides of said rafter 12 and the side sheets 30 and 32 of the saddle member 26 are nailed through holes 36 to the opposite sides of said joist 14.

While preferred forms of the invention have been described, it will be understood that the invention may be utilized in other forms and environments, so that the purpose of the appended claims is to cover all such forms of devices not disclosed, but which embody the invention disclosed herein.

What is claimed and desired to be secured by Letters Patent of the United States is:

1. An add-on roof reinforcing brace for use between an existing elongated roof rafter and its associate elongated ceiling joist, wherein the existing roof rafter angles upwardly relative to a generally horizontally disposed joist, and with said rafter and associate joist being located in substantially the same vertical plane; said add-on roof reinforcing brace comprising, in combination:

an elongated bracing stud of rectangular cross-section and of a length to span the greater portion of the vertical distance between portions of the existing rafter and joist to which the brace is to be attached;

a first attachment means adapted and arranged for securement to one end of the bracing stud;

a second attachment means adapted and arranged for securement to the second end of the bracing stud;

each said attachment means including a first attachment section having portions thereof formed and positioned to cooperate with and secure to at least some of the multiple sides of the bracing stud adjacent the end of the bracing stud, and a second attachment section having portions thereof formed and positioned to cooperate with and secure to at least one longitudinal surface portion of the existing rafter or joist located at a region spaced intermediate the ends of said rafter or joist, and without having to separate any portion of the existing assemblage of rafter and joist;

and at least one of said first and second attachment means providing a pivot means between the first and second attachment sections thereof, whereby said pivoted second attachment section may be selectively angled relative to the longitudinal axis of the stud to which the first attachment section connects to permit attachment portions of said pivotable second attachment section to be moved into an adjacent relationship with at least one longitudinal side of the existing structure to which said pivoted second attachment section is to be secured.

2. A construction as in claim 1 wherein said pivot means between the first and second attachment sections of said attachment means are provided by a plurality of sheet metal members, each of which is shaped and formed to provide an extension that projects from one attachment section toward the other attachment section, the said extensions of the pivot means being arranged and located to lie closely adjacent each other, and to be positioned spaced centrally from and between planes that lie along a pair of parallel longitudinal sides of the bracing stud to which said attachment means is to be secured, and a pivot member cooperating with said plurality of extensions to hold them together adjacent each other while permitting selective pivoting about said pivot member.

3. A roof reinforcing brace as set forth in claim 1 wherein the first attachment section of the first attachment means is formed and shaped to provide a socket, with a bottom and multiple sides extending transversely of the bottom, for receiving thereinto an end of the stud, and with the second attachment section of the first attachment means having a mounting portion thereof secured to said socket bottom and having extending therefrom attachment portions that are each shaped and located in a position for securement thereof to a longitudinal side of the joist.

4. A roof reinforcing brace as in claim 3 wherein the stud is a square-cut length of wood, and wherein said first attachment section is formed of sheet metal, and the second attachment section is a U-shaped sheet metal part that provides thereon a pair of spaced attachment sides that are adapted to lie outside of and against portions of spaced longitudinal sides of a joist.

5. The roof reinforcing brace of claim 1 wherein said second attachment means includes a generally U-shaped member and sleeve means pivotly connected to the U-shaped member and being adapted for securement to an end of said stud means, said U-shaped member providing a pair of parallel side sheets spaced apart by a bight whereby said bight is adapted to engage the bottom surface of a roof rafter and said spaced side sheets are adapted to be secured to the opposite side surfaces of said roof rafter;

said sleeve means of said second attachment means being a hollow, generally rectangularly-shaped member formed by a top member, a pair of opposed side sheets, flanged portions on each of said side sheets of said sleeve means defining edge enclosing sheets, and an open bottom end opposite said top member to receive therein an end of said stud means, whereby said top member is adapted to engage said end of said stud means, said side sheets being adapted for attachment to said stud means, and said flanged portions being adapted to prevent transverse movement of said stud means relative to said sleeve means.

6. The roof reinforcing brace of claim 5 wherein said pivot means for pivotably interconnecting said U-shaped member and said sleeve means of said second attachment means comprises a first extension means extending from the bight of said U-shaped member, oppositely to the direction of projection of said side sheets from said bight; a second extension means extending away from said top member of said sleeve means in a direction opposite to the direction in which said side sheets extend from said top member; and a pivot connecting said first and second extension means so as to provide for pivoting thereabout of the U-shaped member relative to the sleeve means.

7. A roof reinforcing brace as in claim 5 wherein the second attachment means includes a first section formed and shaped from sheet metal to provide a socket with a bottom and multiple sides extending from the bottom in one direction transversely of the bottom, and there being an extension means projecting from said bottom in an opposite direction from said one direction and being shaped and arranged to serve as part of a pivot, and a second section of said second attachment means providing portions thereof pivoted to said pivot, and being shaped to also provide a pair of spaced attachment sides that are adapted to be selectively moved about the axis of the pivot to a position where said pair of spaced attachment sides lie adjacent spaced longitudinal sides of a rafter, positioned to be attached to the rafter.

8. The roof reinforcing brace of claim 1 wherein the first attachment means includes saddle means adapted for securement to a ceiling joist and sleeve means adapted for securement to said stud means.

9. The roof reinforcing brace of claim 8, wherein said saddle means of said first attachment means is a generally U-shaped member defined by a pair of parallel side sheets spaced apart by a bight member, whereby said bight member is adapted to engage a surface of a ceiling joist and said side sheets are adapted to be secured to the opposite side surfaces of said ceiling joist; said sleeve means of said second attachment means being a hollow, generally rectangularly-shaped member formed by a bottom member, a pair of side sheets, flanged portions of each of said side sheets of said sleeve means defining edge enclosing sheets, and an open top end opposite said bottom member to receive therein an end of said stud means, whereby said bottom member is adapted to engage said end of said stud means, said side sheets being adapted for attachment to said stud means, and said flanged portions being adapted to prevent transverse movement of said stud means relative to said sleeve means.

10. The roof reinforcing brace of claim 9, wherein the bight member of the saddle means is secured to the bottom member of the sleeve means to provide an integral structure.

11. A roof reinforcing brace as in claim 1 wherein: the first attachment means is constructed and arranged for attachment between the bracing stud and a joist; the second attachment means is constructed and arranged for attachment between the stud and a rafter; and the pivot means is provided as part of the second attachment means.

* * * * *